United States Patent [19]

Jochum

[11] Patent Number: 4,711,385

[45] Date of Patent: Dec. 8, 1987

[54] EXPLOSIVE POWDER CHARGE ACTUATED FASTENING ELEMENT DRIVING DEVICE

[75] Inventor: Peter Jochum, Meiningen, Austria

[73] Assignee: Hilti Aktiengesellschaft, Fürstentum, Liechtenstein

[21] Appl. No.: 932,658

[22] Filed: Nov. 19, 1986

[30] Foreign Application Priority Data

Nov. 19, 1985 [DE] Fed. Rep. of Germany ..... 3540953

[51] Int. Cl.[4] ..... B25C 1/14

[52] U.S. Cl. ..... 227/10; 60/638

[58] Field of Search ..... 227/9, 10; 173/121, 173/139; 60/637, 638

[56] References Cited

U.S. PATENT DOCUMENTS

| | | | |
|---|---|---|---|
| 3,589,584 | 6/1971 | Ohlsson | 227/10 |
| 3,645,091 | 2/1972 | Ivanov et al. | 227/9 |
| 3,744,240 | 7/1973 | Henning et al. | 60/638 |
| 4,196,834 | 4/1980 | Beton | 227/10 |

*Primary Examiner*—Paul A. Bell
*Assistant Examiner*—James L. Wolfe
*Attorney, Agent, or Firm*—Toren, McGeady & Associates

[57] ABSTRACT

An explosive powder charge actuated fastening element driving device includes a driving piston mounted within a guide bore in an axially extending piston guide for displacement between a firing position and a driving position where the fastening element is driven into a receiving material. After driving a fastening element, the driving piston is returned toward the firing position by exhaust gases generated when a charge is fired. A channel laterally encloses the piston guide with a first and a second aperture, spaced apart in the axial direction, extending through the piston guide communicating between the guide bore and the channel. A blocking slide movable relative to the piston guide is located within the channel. The exhaust gases can flow through the first aperture into the channel and, when the blocking slide is displaced relative to the piston guide, entrapped in a storage space within the channel so that the exhaust gases flow through the second aperture into the guide bore and return the driving piston toward the firing position.

5 Claims, 4 Drawing Figures

EXPLOSIVE POWDER CHARGE ACTUATED FASTENING ELEMENT DRIVING DEVICE

BACKGROUND OF THE INVENTION

The present invention is directed to an explosive powder charge actuated device for driving fastening elements into a receiving material and includes a piston guide in which a driving piston is displaceably mounted and can be driven by the propellent gases generated when an explosive powder charge is fired from a rear firing position into a front driven position. The piston guide has a firing chamber at its rear end in which the charge is inserted and, in addition, apertures spaced apart in the axial direction of the piston guide communicate between the interior of the piston guide and a channel located between the piston guide and the housing enclosing it. In the firing position, the aperture closer to the firing chamber is closed by the piston when the piston is in the firing position.

In the known explosive powder charge actuated fastening element driving devices it is usual, after the driving stroke of the piston against the fastening element, to return the piston by mechanical force from the forward driven position into the rearward firing position. The return operation in the driving devices is cumbersome and time consuming.

To overcome this known disadvantage, an explosive powder charge actuated fastening element driving device is known from U.S. Pat. No. 3,744,240 where the return of the driving piston is effected by the exhaust gases generated by the fired charge. In this known arrangement, the energy available for the return of the driving piston is frequently insufficient to effect a complete return. Such insufficiency results from the loss of exhaust gases which occur from a channel extending along the piston guide which has axially spaced apertures which open into a front region of the guide bore in the piston guide and a rear region of the guide bore adjacent the firing chamber.

SUMMARY OF THE INVENTION

Therefore, the primary object of the present invention is to provide an explosive powder charge actuated fastening element driving device where the driving piston is reliably returned into the firing position by means of exhaust gases.

In accordance with the present invention, a blocking slide is provided for closing off the chnnel. After the exhaust gases flow, during the driving stroke of the piston, from the space acting as the firing chamber through the channel into the front region of the guide bore, the blocking slide moves relative to the piston guide and effects a closure of the channel. The region of the channel located ahead of the blocking slide and the front region of the guide bore form a storage space sealed off from the atmosphere. Exhaust gases compressed within this space are available for returning the driving piston into the position where it is ready to be fired.

Preferably, the blocking slide is a bushing displaceable relative to the piston guide. The bushing can be easily produced as a rotationally symmetrical part and is particularly adapted for use in the channel in the form of an annular space surrounding the piston guide. The bushing is displaceable in the annular space between the piston guide and the housing. Specific portions of the bushing and the housing or the piston guide cooperate in contact with one another for forming a block within the channel.

Preferably, the piston slide is formed as a part of a bolt guide with the guide and slide being displaceable relative to the piston guide. Accordingly, the relative displacement of the bolt guide is used for the control of the blocking slide. When the driving device is not in use or is in a rest position, for safety considerations, the bolt guide projects forwardly out of the housing. In this forward position the blocking slide provides a block or closure for a portion of the channel. When a fastening element is to be driven, the forward end of the bolt guide is pressed against the surface of a receiving material and the bolt guide and with it the blocking slide are displaced rearwardly relative to the piston guide. As a result, the channel is opened between the apertures opening from the guide bore in the piston guide into the channel. When an explosive powder charge is fired within the firing chamber, the piston is driven forwardly through the guide bore. After the desired acceleration of the driving piston has been effected by the propellent gases acting on it, exhaust gases flow out of the guide bore through the aperture closer to the firing chamber into the channel and forwardly through the channel into the aperture more remote from the firing chamber and then into the guide bore.

When the fastening element is driven, recoil forces occur which displace the piston guide and the housing in the rearward direction relative to the combined bolt guide and blocking slide. During such movement, the channel at a point between the two apertures is closed by the blocking slide and a forward closed storage space is created. The exhaust gases compressed within the storage space flow into the guide bore and return the driving piston into its original position ready for firing. When the driving device is lifted off the surface of the receiving material, the bolt guide and blocking slide are maintained in the rest position by a spring biasing action.

Another feature of the invention is the provision of a blocking plate on the blocking slide for closing a vent opening from the channel into the ambient atmosphere. During the driving stroke, the blocking plate closes the vent opening so that exhaust gases do not escape into the atmosphere. As a result, a maximum amount of the exhaust gases are available for effecting the complete return of the driving piston into the original position. After the blocking slide is displaced into the blocking position forming the closed space in the channel, the vent opening is uncovered by the blocking plate. Gases present between the driving piston and the rearward end of the guide bore can escape as the piston moves rearwardly through the rear aperture and the rear region of the channel out through the vent opening so that there is no interference with the return stroke.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

In this description of the driving device shown in FIGS. 1–4 the left-hand end of the device and of the various parts making up the device is the front end and the right-hand end is the rear end. Accordingly, as displayed in FIG. 1, the device has a front end from which the fastening element 24 is driven, note FIGS. 3 and 4.

Figure 1:
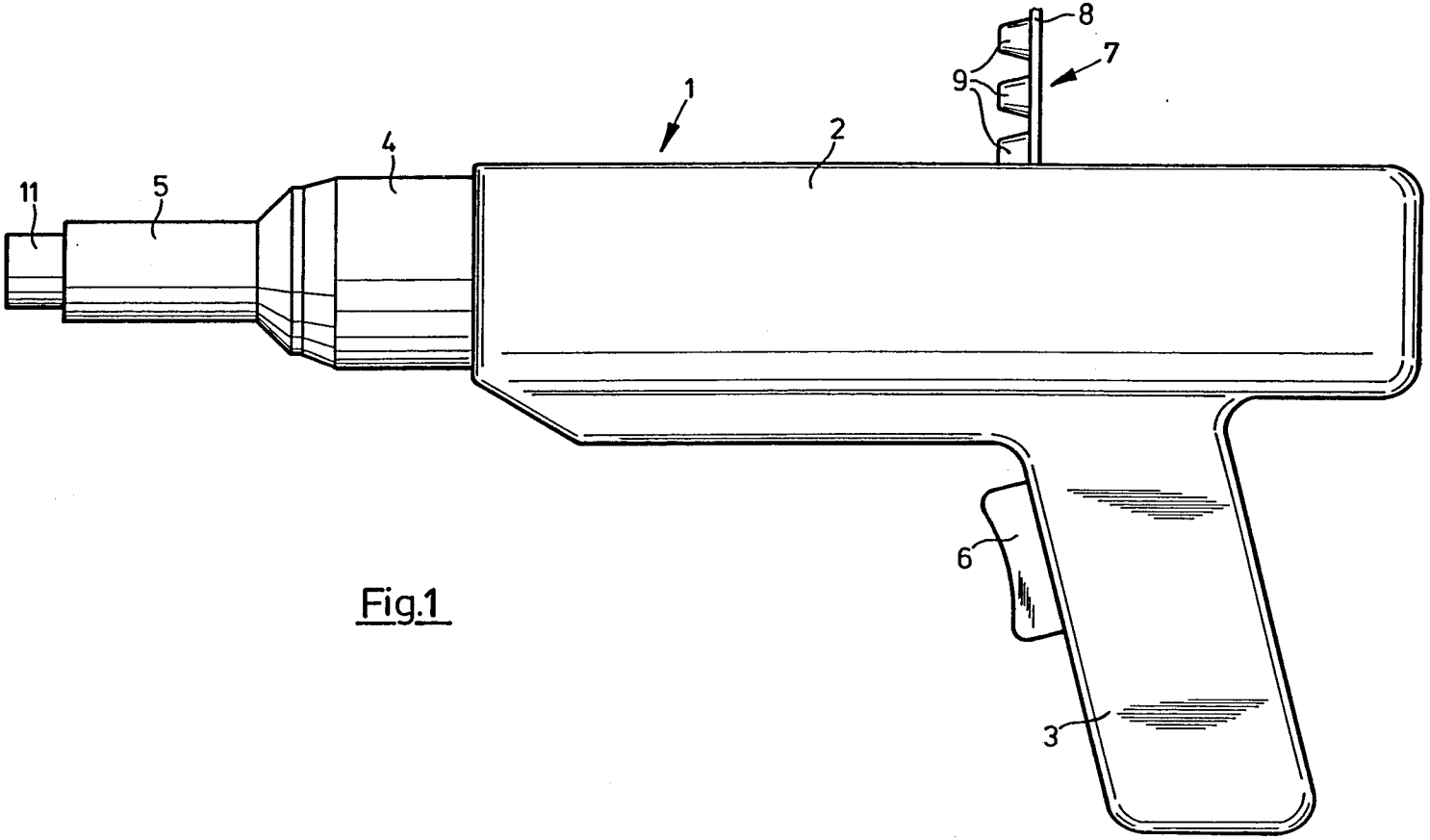
FIG. 1 is a side elevational view of a fastening element driving device in accordance with the present invention with the device shown in the rest position.
Figure 2:
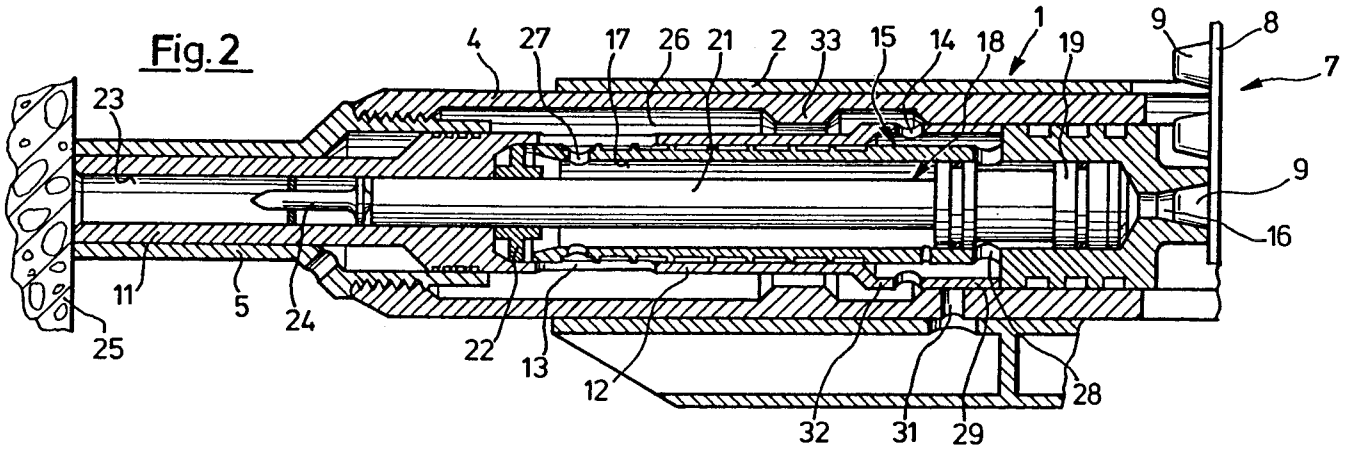
FIG. 2 is a partial axially extending sectional view of the device shown in FIG. 1, on an enlarged scale, with the device illustrated in the firing position.
Figure 3:
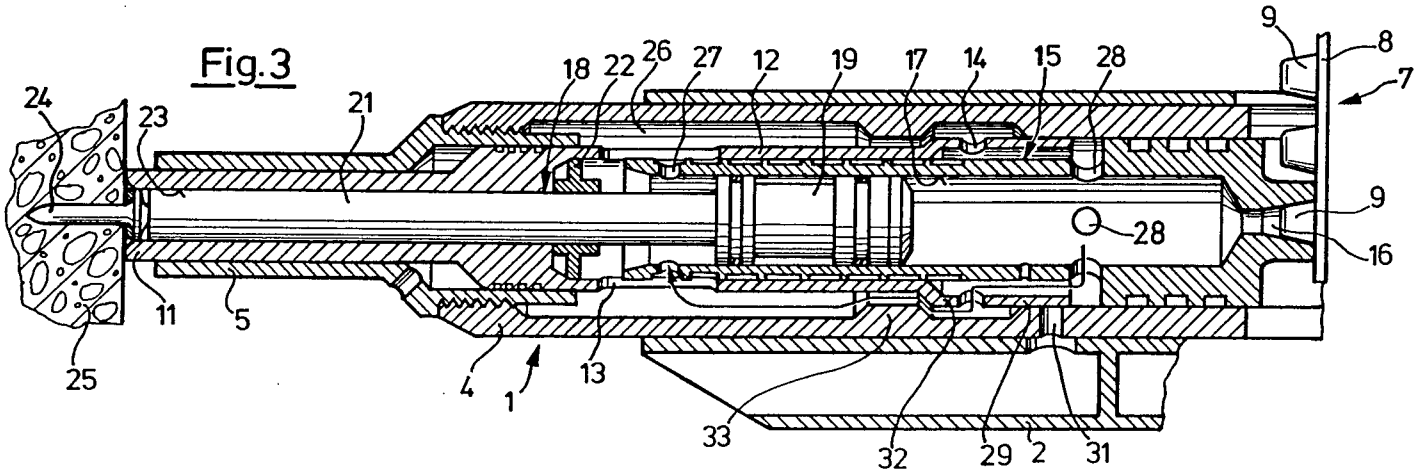
FIG. 3 is a sectional view, similar to FIG. 2, however, displaying the fastening element driven into the receiving material.

In FIG. 1, the driving device includes a housing 1 made up of an outer shell 2 with a pistol-like handle 3 extending downwardly from the shell. A support tube 4 is mounted within the shell and extends from the front end of the shell with a guide tube 5 extending outwardly from the front end of the support tube 4 and extending inwardly into the interior of the housing 1. A trigger 6 for initiating the driving operation is located in the handle 3. An explosive powder charge magazine 7 is shown in FIG. 1 extending downwardly into the housing and magazine can be moved downwardly step-wise into the housing. Magazine 7 is made up of an elongated carrier strip 8 and explosive powder charges 9 mounted in the strip. In the rest position of the driving device as displayed in FIG. 1, a tubular bolt guide 11 is axially displaceably mounted within the guide tube 5 and the front end of the bolt guide projects outwardly from the front end of the guide tube. In the sectional view of FIG. 2, a blocking slide 12 in the form of an axially elongated sleeve is secured to the rear end of the bolt guide 11 and extends from the bolt guide rearwardly toward the rear end of the housing 1. Blocking slide 12 is displaceably supported in a sealed manner adjacent its front end in the guide tube 5 and the rear end of the blocking slide is supported within the support tube 4. Adjacent its front end, the sleeve-like blocking slide has axially extending slots 13 and an opening 14 spaced rearwardly of the slots adjacent to but spaced from the rear end of the blocking slide. An axially extending piston guide 15 is located inwardly of the support tube 4 and extends into the rear end of the blocking slide 12. The piston guide 15 is secured non-displaceably relative to the support tube 4 of the housing 1. The piston guide 15 forms an axially extending central guide bore 17 slidably supporting an axially extending driving piston 18 which extends in the rear end-front end direction of the driving device. The axially elongated driving piston 18 has a piston head 19 at its rear end displaceably supported in a sealed manner within the guide bore 17 with an axially extending shank 21 projecting from the front end of the head with the shank having a smaller diameter than the head. Shank 21 extends through a stop ring 22 at the front end of the guide bore 17 and is displaceably supported, as shown in FIG. 2, at the rear end of the bolt guide 11. The bolt guide 11 forms an outlet bore or muzzle 23 in which the front end of the shank 21 is supported so that a bolt 24, displayed inserted into the bore 23 in FIG. 2, can be driven forwardly out of the front end of the bolt guide into the receiving material 25 as is shown in FIG. 3.

As compared to the rest position of the driving device as set forth in FIG. 1, in FIG. 2 the device is in the firing position with the front end of the device pressed against the surface of a receiving material into which the fastening element is to be driven. In FIG. 2 the front end of the bolt guide 11 has moved inwardly from the projecting arrangement shown in FIG. 1 along with the blocking slide 12 into the rear position in FIG. 2. The driving piston 18 is also located at the rear end of the guide bore 17 with the head located immediately ahead of the firing chamber 16. One of the explosive powder charges 9 is located in the firing chamber.

With the device ready to be fired an axially extending channel 26 is formed as an annular space or volume between the outside of the piston guide 15 and the inside of the support tube 4 of the housing. The channel adjacent its front end is in communication through the longitudinal slots 13 and apertures 27 with the guide bore 17 within the piston guide 15. Toward the rear end of the channel, it communicates with the inside of the guide bore 17 through apertures 28 in the guide tube 15. In the position shown in FIG. 2, the piston head 19 separates the rear aperture 28 from the firing chamber 16. A tubular shaped blocking plate 29 is formed on the rear end of the blocking side 12 and is spaced radially outwardly from the main part of the blocking slide and covers a vent opening 31 preventing discharge from the channel to the ambient atmosphere. Note in FIG. 2 that the blocking plate 29 extends over and closes the vent opening 31.

The driving operation is initiated by pressing the trigger 6 and firing, in a known manner, the explosive powder charge 9 located within the firing chamber 16. With the ignition of the explosive powder charge, highly compressed propellent gases are generated in the firing chamber and they accelerate the driving piston 18 through the piston guide 15 toward the front end of the bolt guide 11 due to the action of the gases on the rear face of the piston head 19. After the piston moves forwardly a relatively short distance, the piston head 19 uncovers the rear apertures 28 in the piston guide 15. As a result, the exhaust gases flow from the firing chamber 16 through the rear end of the guide bore 17 and out through the rear apertures 28 into the rear end of the channel 26 where the gases continue flowing forwardly through the front apertures 27 back into the guide bore 17 forwardly of the piston head, as indicated by the flow arrow in FIG. 3. The reaction forces developed during the driving step cause a recoiling action in the parts non-displaceably connected with the housing 1 causing displacement of the housing 1 and the piston guide 15 in the rearward direction relative to the bolt guide 11 and the sleeve-like sliding block 12, note FIG. 3. Due to the rearward movement of the support tube 4 an annular sealing bead 33 on the support tube moves into contact with an increased diameter section of the sliding block 12. The section 32 and the sealing bead 33 effect a sealing action within the channel 26. Since the sliding block 12 is in sealing contact with the bolt guide 11 a closed storage space or volume is formed within the front region of the channel 26 ahead of the seal provided by the section 32 and the bead 33, note FIG. 4. The compressed exhaust gases trapped within the closed storage space or volume effect a reliable return of the driving piston 18 into its position ready for firing.

Figure 4:
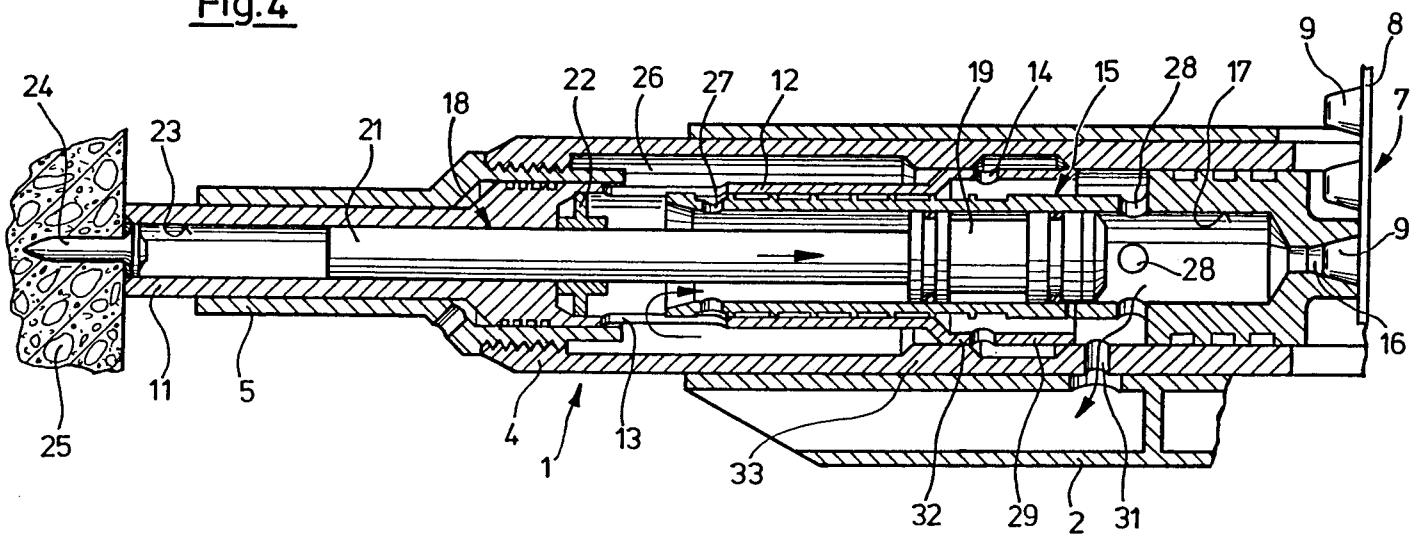
FIG. 4 is a cross-sectional view similar to FIGS. 2 and 3 showing the return stroke of the driving piston.

The remaining exhaust gases located behind the piston head 19 within the guide bore 17 in the piston guide 15 can flow through the rear apertures 28, the rear region of the channel 26, and out through the vent opening 31, as indicated by the arrow in FIG. 4, since the blocking plate 29 has uncovered the vent opening 31 during the displacement of the housing 1 due to the recoil action. When the driving device is removed from the surface of the receiving material 25, the rest position of the device as displayed in FIG. 1, is again achieved and in a known manner another cartridge 9 is inserted into the firing chamber 16 so that the next driving step can be carried out.

While specific embodiments of the invention have been shown and described in detail to illustrate the application of the inventive principles, it will be understood that the invention may be embodied otherwise without departing from such principles.

I claim:

1. Explosive powder charge actuated fastening element driving device comprising a housing, an axially elongated tubular piston guide located within said housing and forming a guide bore having a first end and a second end, a driving piston displaceably mounted within said guide bore, a firing chamber located at the first end of said guide bore for receiving an explosive powder charge so that upon firing the charge propellent gases are generated and directed against said piston for displacing said piston in the direction from the first end toward the second end, said piston guide is spaced inwardly from said housing for at least an axially extending portion spaced between the first and second ends of said bre and forming a channel, said piston guide having a first aperture and a second aperture extending radially therethrough and communicating between said guide bore and said channel, said first aperture and said second aperture are spaced apart in the axial direction of said piston guide with said first aperture located closer to and spaced from the first end of said guide bore and said second aperture located closer to and spaced from the second end of said guide bore, and means located within said channel between said first and second apertures for selectively blocking flow through said channel between said first and second apertures during the operation of said driving device.

2. Explosive powder charge actuated fastening element driving device, as set forth in claim 1, wherein said means comprises an axially extending sleeve-like blocking slide coaxial with said piston guide and laterally encircling said piston guide.

3. Explosive powder charge actuated fastening element driving device, as set forth in claim 2, wherein said blocking slide is an axially extending sleeve-like member displaceable relative to said piston guide in the axial direction.

4. Explosive powder charge actuated fastening element driving device, as set forth in claim 3 wherein a bolt guide is located at the second end of said guide bore and extends axially therefrom, said blocking slide is formed integrally with and extends from said bolt guide toward the first end of said guide bore, and said bolt guide being arranged to bear against the receiving material into which said driving device is to drive a fastening element and said bolt guide being displaceable along with said blocking slide relative to said piston guide.

5. Explosive powder charge actuated fastening element driving device, as set forth in claim 2, wherein said blocking slide includes a blocking plate extending axially from an end of said blocking slide closer to the first end of said guide bore, said housing including a vent opening to the ambient atmosphere extending between said channel and the ambient atmosphere, and said blocking plate being displaceable with said blocking slide for providing a closure of said vent opening.

* * * * *